US005456928A

United States Patent [19]

Hustad et al.

[11] Patent Number: 5,456,928

[45] Date of Patent: Oct. 10, 1995

[54] TAMPER-EVIDENT, FLEXIBLE, RECLOSABLE PACKAGE

[75] Inventors: Gerald O. Hustad, McFarland; Daniel A. Thiemann, Windsor; Cindy M. Wells, Madison, all of Wis.

[73] Assignee: Oscar Mayer Foods Corporation, Madison, Wis.

[21] Appl. No.: 701,360

[22] Filed: May 10, 1991

Related U.S. Application Data

[63] Continuation of Ser. No. 373,399, Jun. 30, 1989, abandoned.

[51] Int. Cl.[6] ..... B65D 50/00

[52] U.S. Cl. ..... 426/87; 426/122; 426/123; 426/127; 206/459.1; 383/5; 383/61; 383/63

[58] Field of Search ..... 426/87, 122, 123, 426/126, 127, 129; 206/610, 632, 459.1; 383/5, 61, 63, 65, 93

[56] References Cited

U.S. PATENT DOCUMENTS

| | | | |
|---|---|---|---|
| 3,172,443 | 3/1965 | Ausnit | 383/61 |
| 3,181,583 | 5/1965 | Lingenfelter | 383/61 |
| 3,780,781 | 12/1973 | Uramoto | 150/3 |
| 4,015,771 | 4/1977 | Sengewald | 229/62 |
| 4,191,230 | 3/1980 | Ausnit | 229/62 |
| 4,235,653 | 11/1980 | Ausnit | 383/63 |
| 4,468,811 | 8/1984 | Shaw et al. | 383/5 |
| 4,483,018 | 11/1984 | Whelan | 383/5 |
| 4,572,377 | 2/1986 | Beckett | 206/632 |
| 4,682,366 | 7/1987 | Ausnit et al. | 383/65 |
| 4,782,951 | 11/1988 | Griesbach et al. | 206/484 |
| 4,786,190 | 11/1988 | Van Erden et al. | 383/61 |
| 4,823,961 | 4/1989 | Griesbach et al. | 383/61 |
| 4,846,585 | 7/1989 | Boeckmann et al. | 383/65 |
| 4,923,309 | 5/1990 | VanEvden | 383/5 |

FOREIGN PATENT DOCUMENTS

| | | | |
|---|---|---|---|
| 0302144 | 2/1989 | European Pat. Off. | 383/5 |

*Primary Examiner*—Anthony J. Weier
*Attorney, Agent, or Firm*—Lockwood, Alex, FitzGibbon & Cummings

[57] ABSTRACT

A reclosable, hermetically-sealed flexible package which has an inner, hermetic peelable seal and a reclosure seal, typically including interlocking closure strips, is provided with one or more of various tamper-evident features which provide an easily visible and noticeable indication of disruption thereof of the type that would gain access to the reclosure seal.

6 Claims, 3 Drawing Sheets

FIG. 5
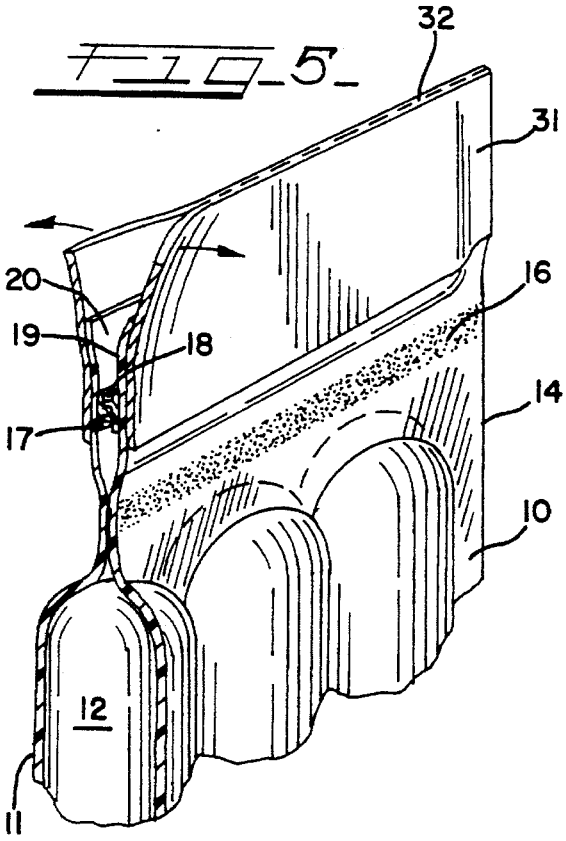
FIG. 6
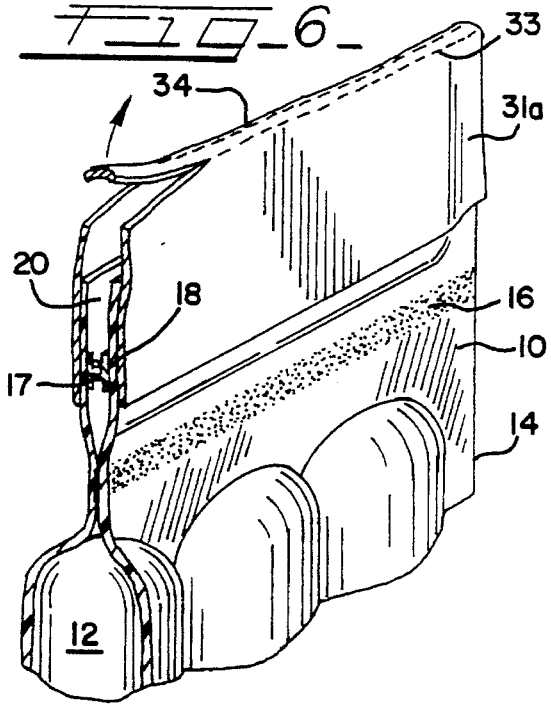
FIG. 7
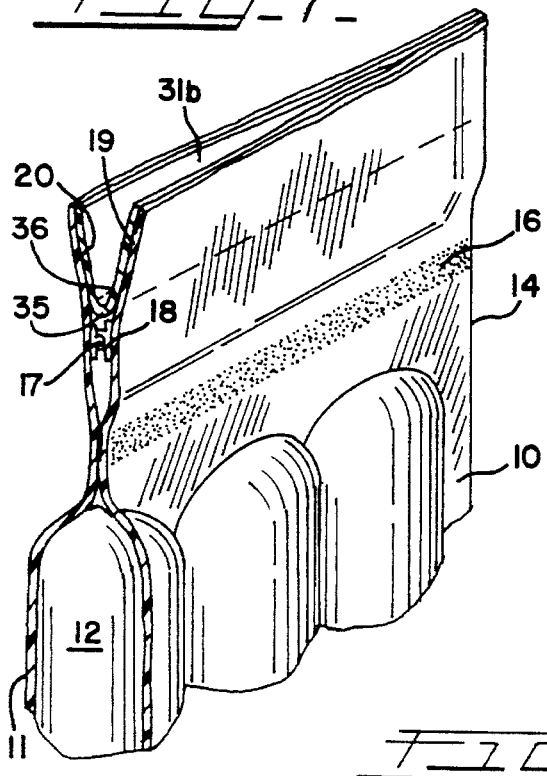
FIG. 8
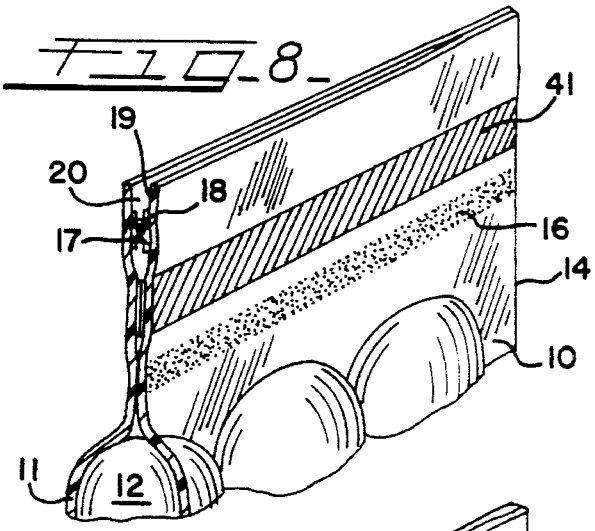
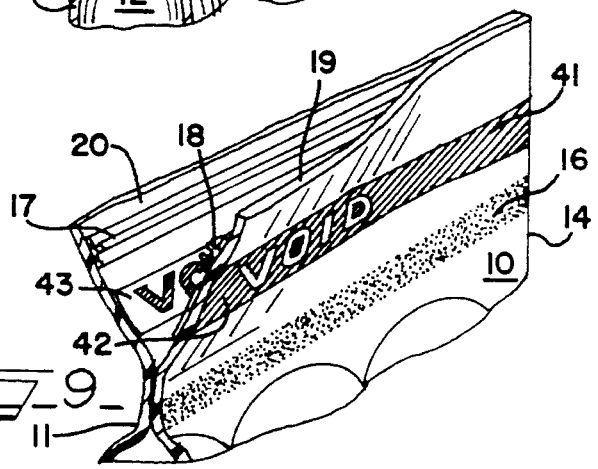
FIG. 9

TAMPER-EVIDENT, FLEXIBLE, RECLOSABLE PACKAGE

This application is a continuation of application Ser. No. 373,399, filed Jun. 30, 1989.

FIELD OF THE INVENTION

This invention relates to flexible, bag-like packages which are provided with an inner, hermetic peel seal and an outer reclosure seal, such as a zipper seal. These packages provide convenience to the consumer in that the contents of the package may be easily accessed by first opening the reclosure seal and then separating the hermetic peel seal. After removing a portion of the package contents, the package can be reclosed by means of the reclosure seal.

DESCRIPTION OF THE PRIOR ART

Flexible packages which have an inner, hermetic peelable seal and an outer zipper seal are presently known for packaging various food products, such as wieners, bacon, sliced luncheon meats, chops, cheese and the like. These packages, including the materials of construction, are fully described in U.S. Pat. Nos. 4,782,951 and 4,823,961 to Hustad and Griesbach which are hereby incorporated by reference. A common use of such packaging is to vacuum seal the food product between two sheets of film material to form a generally rectangularly shaped package which is hermetically sealed (e.g., heat sealed) with a single, non-reclosable seal about three sides and which has an access opening at the fourth side which includes both a hermetic, non-reclosable seal and a reclosure seal.

When the access opening consists of an outer zipper reclosure seal and an inner, non-reclosable, peel seal, it has been found that the package may be opened and then reclosed without showing outwardly visible evidence of such openings. Thus, a package which has been opened and thereafter reclosed, but from which no contents have been removed, would have an outward appearance comparable to a package which retains its inner, hermetic peel seal. A consumer who purchases and thereafter opens a previously-opened package would, of course, especially for vacuum-packed products, be able to determine that the hermetic seal has been broken. Determining that a gas-flushed package had been previously opened might possibly be more difficult. It would, however, be preferred that it be readily apparent to the consumer in the store (i.e., before purchase) that the package had been previously opened.

Various techniques have been known for providing visual, tamper-evident features on flexible packages. U.S. Pat. No. 3,780,781 to Uramoto, U.S. Pat. No. 4,015,771 to Sengevald and U.S. Pat. No. 4,786,190 to Van Erdan et al. are examples of such tamper-evident packages. Tamper-evident features have not, however, been previously used on flexible packages which have an inner, hermetic peel seal and an outer reclosable seal. Copending applications directed to this general combination of features include U.S. patent application Ser. No. 315,352 of Thompson, Hustad and Marnocha, filed Feb. 24, 1989, and U.S. patent application Ser. No. 338,268 of Cornish, Mally, Thiemann and Thompson, filed Apr. 14, 1989.

SUMMARY OF THE INVENTION

The packages of the present invention have a unique combination of features. The packages are in-store tamper-evident, such that it is apparent to the consumer that the package has been opened upon even casual examination of the package. The package is liquid-tight and suitably retains within the package fluids of products contained therewithin, including water, juices, oils and the like. The package has a reclosure seal which can be opened and reclosed a number of times in order to remove portions of the package contents. A zipper seal consisting of interlocking closure strips is the preferred reclosure seal means.

Additionally, the package has a hermetic, inner seal which is an easy-open or peel seal. The peel seal is generally parallel to the reclosure seal and is opened with digital pull-apart forces which may be a continuation of the forces used to open the reclosable seal. The peel seal can maintain a vacuum, a pressurized and/or a modified gaseous environment within the flexible package. The peel seal will be formed by effecting a face-to-face seal between two plys of plastic film with the strength of the seal permitting separation without destruction or tearing of either ply. As described in the Hustad and Griesbach patents, the contacting surface of the two plys should be of dissimilar materials in order to produce the desired peel seal.

The package of this invention further includes a tamper-evident feature which must be disrupted in order to gain access to the product. The disruption of the tamper-evident feature will provide visible evidence of the fact that entry to the contents of the bag, through the reclosure seal and the inner peel seal, may have occurred.

As with the package of the Hustad and Griesbach patents, the tamper-evident, reclosable and hermetically-sealed package of this invention may be made on a single machine using a straight-through process.

The features and objects of the present invention will be readily apparent from the following detailed description thereof taken in conjunction with the accompanying drawings.

BRIEF DESCRIPTION OF THE DRAWINGS

FIG. 5 is a perspective view, partially in cross-section, of a second embodiment of a package in accordance with this invention;

FIG. 6 is a perspective view, partially in cross-section, of a third embodiment similar to that of FIG. 5;

FIG. 7 is a perspective view, partially in cross-section, of a fourth embodiment of a package in accordance with the present invention;

FIGS. 8 and 9 are perspective views, partially in cross-section, of a fifth embodiment, with FIG. 8 showing the embodiment in its closed configuration and FIG. 9 showing the embodiment in its open configuration;

In the drawings, like numerals refer to like elements shown therein.

DETAILED DESCRIPTION OF THE INVENTION

In the description of the preferred embodiments set out below, it will be recognized by those skilled in the art that various alternative materials and structures which are not specifically disclosed are also within the scope of this invention. For purposes of illustration and discussion, each bag panel or ply will be shown as a single heat-sealable laminate. In actual practice, each bag panel will likely be a laminate or two or more layers which will provide sufficient protection to the product (e.g., oxygen and moisture barriers) and which can form a peelable, hermetic heat seal and possibly even a non-peelable, hermetic heat seal at their inner surfaces. As is known to the art, a surface of "Saran", a vinylidene chloride-vinyl chloride copolymer, in contact with a surface of ethylene vinyl acetate can form such peelable bonds. The peel seal should have an opening force of from 1.5 to 6.0 pounds, as discussed in the Hustad and Griesbach patents.

The reclosure seal can be comprised of interlocking closure strips which are adhesively bonded or heat sealed to the inner face of each bag panel. Alternatively, the reclosure elements can be formed during the film extrusion process.

Elements which constitute the tamper-evident feature will preferably be integral with the bag panels prior to the formation of the bag. Where necessary, such as in the formation of certain heat seals, elements of the tamper-evident feature will be added or formed after the bag structure, including the peelable inner seal and the intermediate reclosure seal, has been produced.

Figure 1:
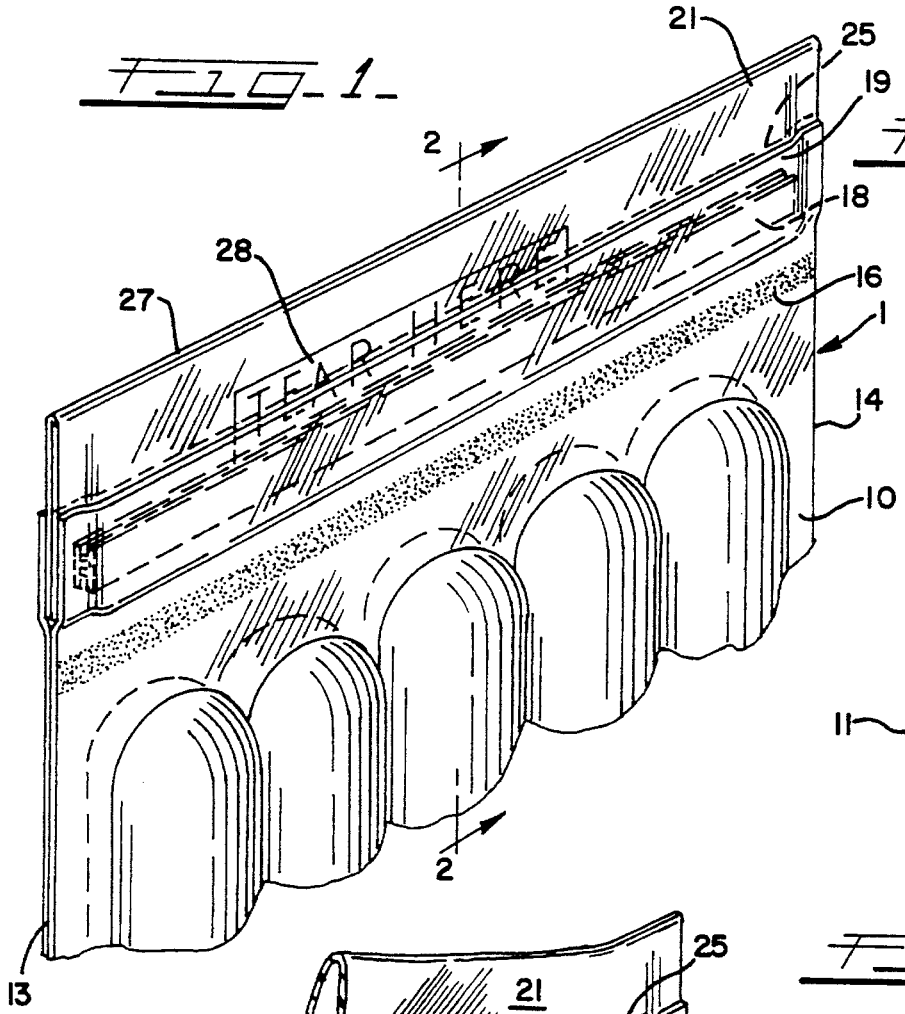
FIG. 1 is a perspective view, partially broken away, of one embodiment of a tamper-evident, reclosable, hermetically-sealed package in accordance with this invention. For purposes of illustration only, the package is shown as containing vacuum-packed wieners.
Figure 2:
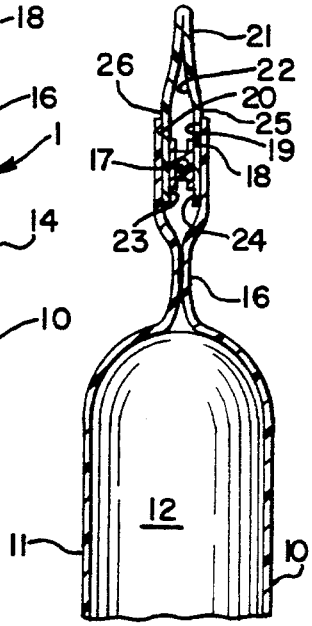
FIG. 2 is a cross-sectional view taken along the line 2—2 of FIG. 1.

FIG. 1 illustrates a package 1 formed of front and back bag panels 10 and 11 which enclose a plurality of wiener or wiener-shaped products 12. The wieners 12 are vacuum-packed so that the bag panels are in intimate contact with the surface of the wieners. Bag panels 10 and 11 are sealed along side edges 13 and 14 by means of continuous heat seals. The bottom edge (not shown) of the bag may be an additional heat seal. Alternatively, any or all of the side edges and the bottom edge may be a fold which forms a continuous sheet into opposed panels 10 and 11. A hermetic, peel seal extends across the width of the package at 16, the seal being formed by adherent contact between films 10 and 11 as a result of known heat-sealing equipment and techniques.

The same heat may be applied to side seals 13 and 14 and bottom seal as is applied to seal area 16 such that all of those seals are equally peelable. The structure of the bag would, however, essentially preclude opening of seals 13, 14 and the bottom seal during normal use. Alternatively, these seals can be formed as non-peelable seals such as by supplying more heat to form these seals than to form seal area 16 or by applying a coating at seal area 16 to prevent formation of a permanent, non-peelable seal.

Interlocking reclosure strips 17 and 18 are bonded to bag panels 10 and 11 at a location which is parallel to, spaced apart from, and outside of the seal area 16. As shown, reclosure strips 17 and 18 are also recessed in the mouth of the package 1, away from the top edges of the bag.

Positioned between the lips (19 and 20) of the bag is a tamper-evident component 21 which is bonded to the inner face of lips 19 and 20. According to the embodiment of FIGS. 1–4, tamper-evident component 21 takes the form of the upper, folded over portion of a film member 22 including the interlocking reclosure strips 17 and 18. More particularly, the film member 22 is folded on itself in a manner that permits proper interlocking engagement between the interlocking reclosure strips 17 and 18. The free end portions 23, 24 containing the interlocking reclosure strips 17 and 18, respectively, are secured by suitable generally permanent bonding means to the lips 20 and 19, respectively. The tamper-evident component 21 of this embodiment is further defined by perforations generally adjacent to the lips 19, 20. Preferably, two rows of perforations 25 and 26 are provided in order to facilitate opening of the package 1 by grasping the tamper-evident component 21 in one hand and the top or lip portion of the package 1 in the other hand, whereby the tamper-evident component can be ripped or torn away.

Figure 3:
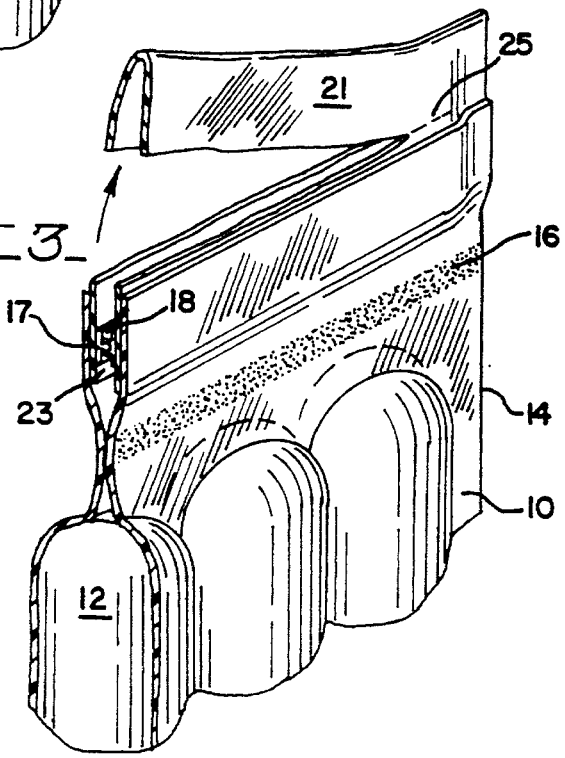
FIG. 3 is a perspective view, partially in cross-section, illustrating the tear-away aspect of this embodiment.
Figure 4:
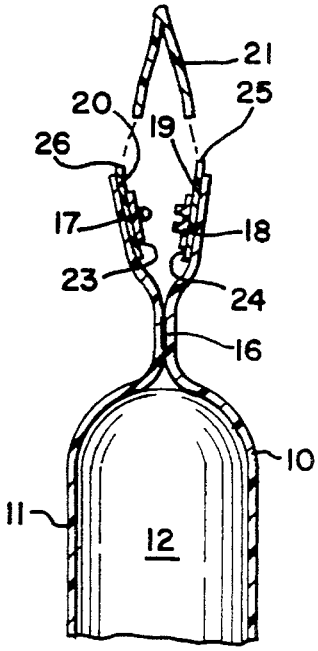
FIG. 4 is a cross-sectional view generally vertically oriented and showing the tear-away orientation of FIG. 3.

If desired, provision could be made for indicating that the component had been removed in order to thereby signal possible tampering or damage prior to purchase by the consumer. This could take the form of a message area 28 which is severed when the perforations are torn through. Alternatively, means could be provided to require much more than digital forces to completely remove the tamper evident component. For example, the rows of perforations can continue for less than the full length of the tamper-evident component 21, as is generally shown in FIG. 3. Other alternative or additional means could be incorporated, such as by providing a stop structure or by providing a thickened plastic area at one end of the tamper-evident component. Tamper-evident component 21 could be a heavier extrusion mass than film member 22 to provide more material for gripping and tearing.

By tearing away the tamper-evident component 21, access is gained to the lips 19 and 20 and to the interlocking reclosure strips secured thereto, which permits opening of the peel-seal 16 and access to the wieners 12 or the like. As previously stated, the perforations can be generally adjacent to either or both of the lips 19, 20. In this regard, such perforations can be positioned along the web 22 anywhere between a location of at least 1/16th inch below top edge 27 to a location as low as the interlocking reclosure strips 17, 18, which latter location may be below the free edge of the lips 19, 20.

The embodiment illustrated in FIGS. 1 through 4 is advantageous because it is especially well-suited to being formed, filled and sealed on existing machinery, requiring minimal modifications to the packaging machinery and/or material used in forming packages having reclosure strips. In addition, this embodiment provides an easily understood tamper indicator while requiring no additional package film or other tamper indicating component, inasmuch as the one-piece film member including the interlocking reclosure strips performs the tamper-evident feature.

With reference to the embodiments shown in FIG. 5 and in FIG. 6, tamper-evident component 31, 31a includes a strip, preferably made of a cellulosic material, which is folded onto itself and secured in a generally permanent manner to the package. More specifically, the free end portions of the tamper-evident strip are secured to the respective outside surfaces of the lips 19 and 20. This strip may be continuous (covering the entire package) or non-continuous acting as a saddle band. By this arrangement, access which permits opening of the interlocking reclosure strips 17 and 18 is possible only upon severance or ripping of the tamper-evident strip. In FIG. 5, such severance or the like is facilitated by a single row of perforations 32, preferably located at the top edge of the strip 31. In the embodiment of FIG. 6, dual, generally opposing rows of perforations 33 and 34 are provided. Strips 31, 31*a* can be secured to the package by means of an especially aggressive adhesive, such as one that is particularly well-suited to substantially permanently bind cellulosic materials to polymeric or plastic materials. Also, a message area could span the perforations in the general manner of area 28 shown in FIG. 1.

FIG. 7 illustrates an embodiment in which the tamper-evident component is a strip 31*b*, preferably of cellulosic material, which is substantially permanently secured to the inside surface of the opposing lips 19 and 20. In this embodiment, the folded over edge 35 of the tamper-evident strip 31*b* is oriented generally downwardly and is somewhat closely spaced from the interlocking reclosure strips 17 and 18. Access to the strips 17 and 18 is gained by severing, tearing or cutting the strip 31*b* in the general area of the folded over edge 35. This can be facilitated by one or more rows of perforations 36, and a severable message area could also be included. As is the case for the embodiments of FIGS. 5 and 6, an important feature of this FIG. 7 embodiment is to provide an especially aggressive adhesive for securing cellulosic materials or the like to polymeric packaging materials.

The embodiment of FIG. 8 and FIG. 9 includes a tamper-evident composite 41 that extends across substantially the entire transverse length of the package. An especially convenient location for tamper-evident composite 41 is between the hermetic peel-seal 16 and the interlocking reclosure strips 17, 18. Other suitable locations are below or within the peel-seal 16. In those circumstances in which the area above the reclosure strips 17, 18 is deep enough to accommodate tamper-evident composite 41, such can be positioned above the strips 17, 18. Composite 41 is a labeling type of material which is the nature of a composite that is separable into two components which are readily apparent when the composite 41 is pulled apart upon gaining access to and/or opening the interlocking reclosure strips 17, 18.

Further considering the tamper-evident composite 41, this typically has a generally uniform appearance, as generally shown in FIG. 8, before separation thereof into a positive component 42 and a negative component 43, as shown in FIG. 9. Typically, same has the appearance of a generally opaque colored strip. For example, the tamper-evident composite 41 could provide the appearance of a white strip positioned between the front and back panels 10 and 11. Upon separation of the composite 41 into the positive component 42 and the negative component 43, one area of the coloration (such as the white wording shown on positive component 42 in FIG. 9) remains secured to the front bag panel 10, while the remainder of the coloration area (such as the white background shown on negative component 43 shown in FIG. 9) remains secured to the back bag panel 11. In the illustration shown in FIG. 9, the darkened background area of positive component 42 and the darkened letters shown on negative component 43 are areas where the coloration has been removed and the natural appearance of the panels 10 and 11 (for example substantial transparency) is evident. Once the separation of the composite 41 into the components 42 and 43 has taken place, it is not possible to reverse the onset of the appearance property differences, which includes the readability of the message such as "VOID" shown in FIG. 9. A material that is suitable for providing the tamper-evident composite 41 is a label stock material known by the trademark "Securemark" of 3M Company.

Figure 10:
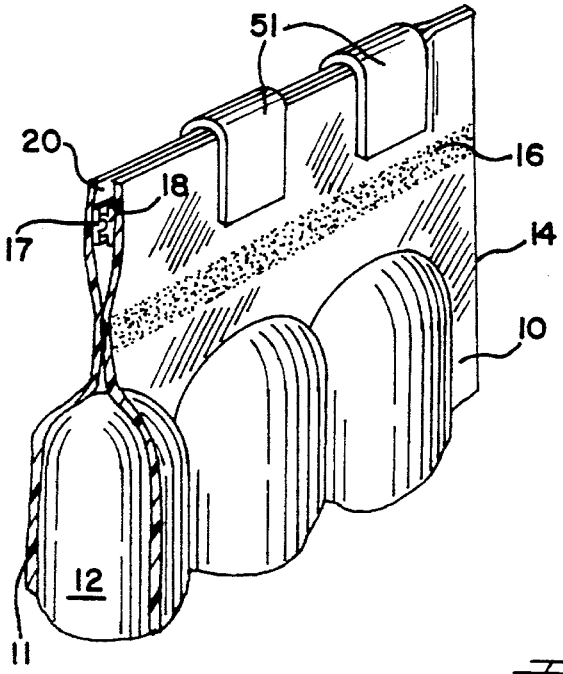
FIGS. 10 and 11 are perspective views, partially in cross-section, of a sixth embodiment of a package according to the present invention, FIG. 10 illustrating the embodiment in its closed orientation, and FIG. 11 showing the embodiment in an open orientation.
Figure 11:
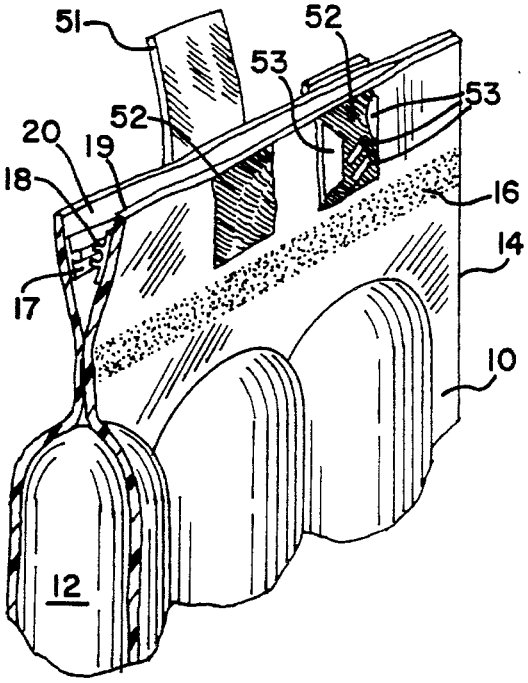

FIGS. 10 and 11 show a tamper-evident component 51 which takes the form of one or more lengths of aggressively adherent tape which is folded over the mouth of the package such that the lips 19 and 20 are in general engagement with each other. The tamper-evident lengths of tape 51 have two distinct attributes which preclude undetected removal of the lengths 51. One of these attributes is that, after the length of tape is adhered to the panels 10 and 11, the adhesive material thereof imparts an obvious and distinct discoloration area 52 on the polymeric material out of which the package panels are constructed. Another feature is that the tape length 51 has a shreddable attribute, whereby it is extremely difficult to completely remove the entirety of the length of tape without leaving residue shreds 53.

Figure 13:
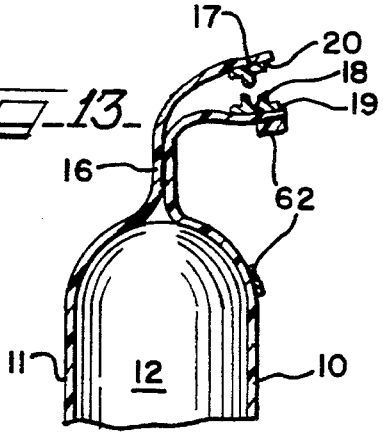
FIG. 13 is a cross-sectional view of an embodiment on the order of FIG. 12.
Figure 12:
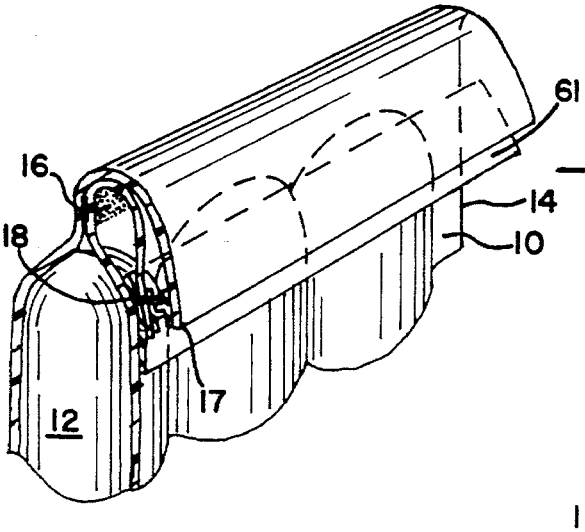
FIG. 12 is a perspective view, partially in cross-section, of a seventh embodiment of a package according to the present invention.
Figure 14:
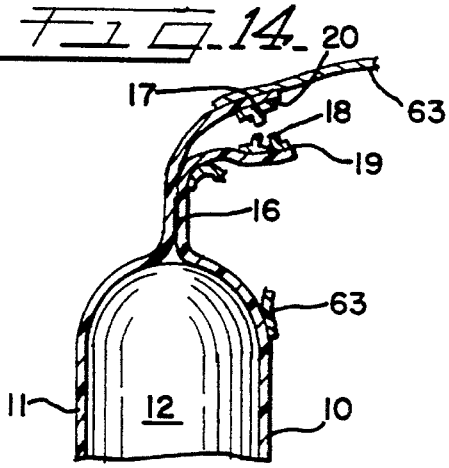
FIG. 14 is a cross-sectional view of yet another embodiment on the order of that illustrated in FIG. 12.

FIGS. 12, 13 and 14 illustrate embodiments wherein the upper portion of the package is folded over on itself in order to define a doubled-over package top as generally shown such that the free top edge portion is closely adjacent to or touches one of the bag panels 10 or 11. The tamper-evident component takes the form of an adhesive bead and/or a sheet having adhesive properties which impart either a one-time adherence characteristic or has some other attribute which indicates that the sheet has been detached from its initially, as-sealed condition. For example, FIG. 13 illustrates the option of having a one-time adhesive bead 62 to maintain the doubled-over orientation until the package is opened, as shown. A typical adhesive bead in this regard would be that a of hot-melt adhesive which is not of the pressure-sensitive variety or does not include any other properties which would permit resealing or substantial re-adherence once detachment has occurred.

When this tamper-evident component is a sheet 61 between the doubled-over package top and one of the bag panels, as in FIG. 12, it can, for example, take the form of the tamper-evident composite 41, of the tamper-evident tape length 51, or of some other material which will not permit undetected reattachment. For example, sheet 61 could also include perforations and optionally with tamper-indicating printing thereat; cellulosic materials are especially suitable for this type of sheet.

Tamper-evident sheets of these types can alternatively or additionally be positioned over the outside surface of the doubled-over end, as shown in FIG. 14. Sheets 63 falling into this latter category include sheets of cellulosic or non-cellulosic material that will either sever or will peel away without the ability to be readily reattached. Also included in this category are sheets which have an adhesive or the like that imparts a one-time adherence property thereto. Sheet 63 can be perforated or contain a tear strip to ensure that severance occurs and some of the material remains on the bag panel to provide a further indicator that the package is no longer in its totally sealed state. Sheet 63 can also include printing through the tear location.

While various embodiments of packages illustrating this invention have been described, it will be apparent that certain modifications and variations therefrom may be made without departing from the spirit and scope of this invention. Accordingly, only such limitations are to be imposed thereon as are indicated in the appended claims.

We claim:

1. In a reclosable, flexible package within which a product is hermetically sealable, wherein the package includes opposing wall panels joined to form not more than three permanently sealed sides and an access side along which said opposing panels terminate at top edges, said access side sealed with a hermetic peel seal positioned adjacent to and inwardly from said top edges, the improvement comprising reinforced tamper-evident means that must be disrupted in order to gain entry to the product thereby providing visible evidence of said entry, said tamper-evident means includes a one-piece, folded continuous film member having opposing free ends inserted between said top edges and bonded to said opposing wall panels inwardly from said top edges and outwardly from said hermetic peel seal, said opposing free ends defining inner surfaces opposing each other, said film member including interlocking closure strips on said respective inner surfaces of said folded continuous film member adjacent to said opposing free ends, outer surfaces of said free ends of said folded continuous film member being bonded to said opposing wall panels adjacent to said top edges, whereby said interlocking closure strips and said opposing free ends of the folded continuous film member are bonded to an overlap the opposing wall panels at a location between said top edges of the opposing wall panels and said hermetic peel seal thereby providing a reinforced reclosure seal area, said hermetic peel seal being positioned between said interlocking closure strips and the product, and said tamper-evident means includes a tamper-evident component exposed outwardly from said top edges such that said component is a tear strip that is unreinforced by said opposing wall panels and said component must be disrupted to gain entry to said package, said tamper-evident component includes perforations to facilitate opening of said package by serving said tamper-evident component, whereby disruption to said tamper-evident component provides visible evidence of attempted or actual entry to said package.

2. The package according to claim 1, wherein said opposed wall panels include oxygen-impermeable film, and said package is for enclosing perishable food products.

3. The package according to claim 1, wherein said tamper-evident component includes rows of said perforations adjacent to said top edges.

4. The package according to claim 1, wherein said perforations are adjacent to said top edges.

5. The package according to claim 1, wherein said opposing wall panels are a laminate of two or more layers.

6. The package according to claim 1, wherein said tamper-evident component includes a message area through which said perforations extend.

* * * * *

UNITED STATES PATENT AND TRADEMARK OFFICE

CERTIFICATE OF CORRECTION

PATENT NO. : 5,456,928

DATED : October 10, 1995

INVENTOR(S) : Gerald O. Hustad, Daniel A. Thiemann and Cindie M. Wells

It is certified that error appears in the above-indentified patent and that said Letters Patent is hereby corrected as shown below:

On the title page, item [75], "Inventors", "Cindy" should read --Cindie--; under "References Cited", U.S. Patent No. 4,923,309, "VanEvden" should read --VanErden--.

Col. 1, line 34, "non-reclosable, peel" should read --non-reclosable peel--; line 52, "Van Erdan" should read --Van Erden--.

Col. 6, line 33, "a of hot-melt" should read --of a hot-melt--.

Col. 7, line 23, "an overlap" should read --and overlap--.

Signed and Sealed this

Thirteenth Day of August, 1996

*Attest:*

Bruce Lehman

BRUCE LEHMAN

*Attesting Officer*

*Commissioner of Patents and Trademarks*